US011115775B2

(12) United States Patent
Sapozhnykov

(10) Patent No.: US 11,115,775 B2
(45) **Date of Patent: *Sep. 7, 2021**

(54) METHOD AND APPARATUS FOR ACOUSTIC CROSSTALK CANCELLATION

(71) Applicant: Cirrus Logic International Semiconductor Ltd., Edinburgh (GB)

(72) Inventor: Vitaliy Sapozhnykov, Edinburgh (GB)

(73) Assignee: Cirrus Logic, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/796,312

(22) Filed: Feb. 20, 2020

(65) Prior Publication Data

US 2020/0196089 A1 Jun. 18, 2020

Related U.S. Application Data

(63) Continuation of application No. 15/447,944, filed on Mar. 2, 2017, now Pat. No. 10,595,150.

(60) Provisional application No. 62/304,454, filed on Mar. 7, 2016.

(51) Int. Cl.
*H04S 7/00* (2006.01)
*H04S 1/00* (2006.01)

(52) U.S. Cl.
CPC ..... *H04S 7/307* (2013.01); *H04S 1/002* (2013.01); *H04S 7/305* (2013.01); *H04R 2499/11* (2013.01); *H04S 2400/09* (2013.01); *H04S 2420/01* (2013.01)

(58) Field of Classification Search
None
See application file for complete search history.

(56) References Cited

U.S. PATENT DOCUMENTS

| | | | |
|---|---|---|---|
| 5,870,484 | A | 2/1999 | Greenberger |
| 6,424,719 | B1 | 7/2002 | Elko et al. |
| 6,760,447 | B1 | 7/2004 | Nelson et al. |
| 6,950,524 | B2 | 9/2005 | Nelson et al. |
| 7,536,017 | B2 | 5/2009 | Sakurai et al. |
| 7,835,535 | B1 | 11/2010 | Trautmann et al. |

(Continued)

FOREIGN PATENT DOCUMENTS

| | | | |
|---|---|---|---|
| EP | 1696702 | A1 | 8/2006 |
| EP | 2612437 | A | 7/2013 |

(Continued)

OTHER PUBLICATIONS

Combined Search and Examination Report under Sections 17 and 18(3), UKIPO, Application No. GB1715062.4, dated Mar. 19, 2018.

(Continued)

*Primary Examiner* — Qin Zhu
(74) *Attorney, Agent, or Firm* — Jackson Walker L.L.P.

(57) ABSTRACT

An acoustic crosstalk canceller is determined for an asymmetric audio playback device, by determining a transfer function of an acoustic stereo playback path having asymmetries defined by speakers of the playback device. The transfer function is inverted to determine an inverse transfer function. The inverse transfer function is regularised by applying frequency dependent regularisation parameters to obtain an acoustic crosstalk canceller. Also, the inverse transfer function could be regularised for symmetric playback paths by applying aggregated frequency dependent regularisation parameters to obtain an acoustic crosstalk canceller without band branching.

27 Claims, 7 Drawing Sheets a)

(56) References Cited

U.S. PATENT DOCUMENTS

| | | | |
|---|---|---|---|
| 9,167,344 | B2 | 10/2015 | Choueiri |
| 2003/0161478 | A1 | 8/2003 | Nelson et al. |
| 2007/0019812 | A1 | 1/2007 | Kim |
| 2007/0076892 | A1 | 4/2007 | Kim |
| 2007/0154019 | A1 | 7/2007 | Kim |
| 2008/0025518 | A1 | 1/2008 | Mizuno et al. |
| 2009/0003610 | A1 | 1/2009 | Gustaysson et al. |
| 2009/0086982 | A1 | 4/2009 | Kulkarni et al. |
| 2010/0232617 | A1 | 9/2010 | Hartung et al. |
| 2011/0274283 | A1 | 11/2011 | Athanas |
| 2011/0305358 | A1 | 12/2011 | Nishio et al. |
| 2012/0020480 | A1 | 1/2012 | Visser et al. |
| 2013/0163766 | A1 | 6/2013 | Choueiri |
| 2013/0216071 | A1 | 8/2013 | Maher et al. |
| 2014/0064526 | A1 | 3/2014 | Otto et al. |
| 2014/0286511 | A1 | 9/2014 | Nakano |
| 2014/0321680 | A1 | 10/2014 | Takahashi et al. |
| 2015/0172812 | A1 | 6/2015 | Wu |
| 2016/0080886 | A1 | 3/2016 | De Bruijn et al. |
| 2016/0150339 | A1 | 5/2016 | Choueiri |
| 2016/0227338 | A1 | 8/2016 | Oh |
| 2017/0272882 | A1 | 9/2017 | Oh |
| 2017/0325042 | A1 | 11/2017 | Lacouture Parodi |

FOREIGN PATENT DOCUMENTS

| | | | |
|---|---|---|---|
| WO | 2006076926 | A2 | 7/2006 |
| WO | 2009004352 | A1 | 1/2009 |
| WO | 2012036912 | A1 | 3/2012 |
| WO | 2016033358 | A1 | 3/2016 |
| WO | 2016131471 | A1 | 8/2016 |

OTHER PUBLICATIONS

Elliott, S. J., Signal Processing for Active Control (Academic Press, San Diego, CA, 2001), pp. 481-486.

Takeuchi, Takashi et al., Optimal Source Distribution for Binaural Synthesis over Loudspeakers, J. Acoust. Soc. Am. 112 (6), Dec. 2002, pp. 2786-2797.

Papadopoulos, P. et al., "Choice of inverse filter design parameters in virtual acoustics imaging systems." J. Audio Eng. Soc., 58(1/2), pp. 22-35, 2010.

Golub, Gene H.; Van Loan, Charles F. (1996), Matrix Computations (3rd ed.), pp. 70-71 and pp. 242-243.

Choueiri et al, "Optimal Crosstalk Cancellation for Binaural Audio with Two Loudspeakers", 2011.

Kirkeby et al., "The 'Stereo Dipole', A Virtual Source Imaging System Using Two Closely Spaced Loudspeakers", J. Audio Eng. Soc., vol. 46, No. 5, May 1998.

Rao et al., A Minimax Approach for the Joint Design of Acoustic Crosstalk Cancellation Filters, IEEE Transactions on Audio, Speech, and Language Processing, vol. 15, No. 8 Nov. 2007.

International Search Report and Written Opinion of the International Searching Authority, Application No. PCT/IB2017/051219, dated Jun. 9, 2017.

Combined Search and Examination Report under Sections 17 and 18(3), UKIPO, Application No. GB1703522.1, dated Sep. 15, 2017.

a)

b)

METHOD AND APPARATUS FOR ACOUSTIC CROSSTALK CANCELLATION

This application is a continuation of U.S. patent application Ser. No. 15/447,944, filed Mar. 2, 2017, which claims benefit of U.S. Provisional Patent Application Ser. No. 62/304,454, filed Mar. 7, 2016, each of which is incorporated by reference herein in its entirety.

TECHNICAL FIELD

The present invention relates to speaker playback of stereo or multichannel audio signals, and in particular relates to a method and apparatus for processing such signals prior to playback in order to improve the stereo perception perceived by a listener upon playback.

BACKGROUND OF THE INVENTION

Stereo playback of audio signals typically involves delivering a left audio signal channel and a right audio signal channel to respective left and right speakers. However, stereo playback depends upon the left and right speakers being positioned widely apart enough relative to the listener. In particular there must be a relatively large difference between the angles of incidence of the respective acoustic signals from the left and right speakers in order for the listener's natural binaural stereo hearing to produce a stereo perception. This is because if playback occurs from two relatively closely spaced loudspeakers which present a relatively small difference in angle of incidence of the respective acoustic signals, then the audio from each respective speaker is also heard by the contralateral ear at a similar amplitude and with relatively little differential delay. This effect is known as acoustic crosstalk. The perceptual result of crosstalk is that perceived stereo cues of the played audio may be severely deteriorated, so that little or no stereo effect is perceived.

Acoustic crosstalk can be sufficiently avoided, and a stereo perception can be delivered to the listener(s), by placing the left and right speakers far apart relative to the listener(s), such as many metres apart at opposite sides of a room or theatre. However, this is not possible when using a physically compact audio playback device such as a smartphone or tablet, as the onboard speakers of such devices cannot be positioned far apart relative to the listener. Smart phones are typically around 80-150 mm on the longest dimension, while tablets are typically around 170-250 mm on the longest dimension, and in such devices the onboard speakers can be positioned no further apart than the furthest apart corners or sides of the respective device. Even if the device is brought inconveniently close to the listener in an attempt to increase the difference between the respective angles of incidence of the left and right acoustic signals to the listener's ears, this still fails to generate any significant stereo perception from the onboard speakers due to the small size of the compact device.

To date the only way to achieve a suitable perceptible stereo playback when using compact playback devices is to use additional external speakers, such as headphone speakers or loudspeakers, driven from the playback device. However this introduces additional cost, size and weight of such external hardware and runs counter to the intended compact and lightweight mode of use of compact devices, while also reducing the achieved utility of the onboard speakers.

Attempts have been made to pre-process the left and right channels prior to playback in order to cancel acoustic crosstalk and provide the listener with a stereo perception when the speakers are relatively close together. However, these approaches have suffered from a number of problems including being highly sensitive to the position of the listener's head relative to the playback device whereby even very slight head movements significantly diminish the perceived stereo effect and rapidly escalate spectral coloration producing unpleasant sound corruption, and also adding a substantial load on both transducers.

Past attempts at acoustic crosstalk cancellation (XTC) have also suffered from a failure to optimise crosstalk cancellation evenly across the audio spectrum. It has been suggested to resolve this by frequency dependent regularisation involving hierarchical spectral division responsive to listening conditions, however this entails determining the frequency divisions and in turn complicates the crosstalk canceller design, which imports a significant processing burden and increased memory requirements, which is undesirable for typical compact playback devices. In particular the band branching method requires the input audio to be divided into numerous sub-bands, the widths of which are dependent on the playback geometry, sampling frequency etc. Then, each band is processed separately by a XTC design specifically for each band using a corresponding regularisation parameter. This is thus a complex XTC structure which undesirably increases processor and memory requirements of the crosstalk canceller.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

According to a first aspect the present invention provides a method of determining an acoustic crosstalk canceller for an asymmetric audio playback device, the method comprising:

determining a transfer function of an acoustic stereo playback path having asymmetries defined by speakers of the playback device;

inverting the transfer function to determine an inverse transfer function;

regularising the inverse transfer function by applying frequency dependent regularisation parameters to obtain an acoustic crosstalk canceller.

According to a second aspect the present invention provides a device for determining an acoustic crosstalk canceller for an asymmetric audio playback device, the device comprising:

a processor configured to determine a transfer function of an acoustic stereo playback path having asymmetries defined by speakers of the playback device; invert the transfer function to determine an inverse transfer function; and regularise the inverse transfer function by applying frequency dependent regularisation parameters to obtain an acoustic crosstalk canceller.

According to a third aspect the present invention provides a method of reducing acoustic crosstalk at a time of audio playback, the method comprising:

passing a stereo audio signal through a crosstalk canceller, wherein the crosstalk canceller comprises a regularised inverse transfer function of an acoustic stereo playback path having asymmetries defined by stereo playback speakers, wherein the crosstalk canceller has been regularised by frequency dependent regularisation parameters; and passing an output of the crosstalk canceller to the stereo playback loudspeakers for acoustic playback.

According to a fourth aspect the present invention provides a device for reducing acoustic crosstalk at a time of audio playback, the device comprising;

a processor configured to pass a stereo audio signal through a crosstalk canceller, wherein the crosstalk canceller comprises a regularised inverse transfer function of an acoustic stereo playback path having asymmetries defined by stereo playback speakers, wherein the crosstalk canceller has been regularised by frequency dependent regularisation parameters; and further configured to pass an output of the crosstalk canceller to the stereo playback speakers for acoustic playback.

The asymmetries defined by the speakers of the playback device may comprise one, some or all of non-identical speaker frequency response, non-symmetrical speaker directivity, and non-symmetrical speaker placement.

According to a fifth aspect the present invention provides a method of determining an acoustic crosstalk canceller for an audio playback device, the method comprising:

determining a transfer function of an acoustic stereo playback path;

inverting the transfer function to determine an inverse transfer function;

regularising the inverse transfer function by applying aggregated frequency dependent regularisation parameters, to obtain an acoustic crosstalk canceller without band branching.

According to a sixth aspect the present invention provides a non-transitory computer readable medium for determining an acoustic crosstalk canceller for an audio playback device, comprising instructions which, when executed by one or more processors, causes performance of the steps of the method of the first and/or fifth aspects of the invention.

According to a seventh aspect the present invention provides a device for determining an acoustic crosstalk canceller for an audio playback device, the device comprising; a processor configured to determine a transfer function of an acoustic stereo playback path; invert the transfer function to determine an inverse transfer function; and regularise the inverse transfer function by applying aggregated frequency dependent regularisation parameters, to obtain an acoustic crosstalk canceller without band branching.

According to an eighth aspect the present invention provides a method of reducing acoustic crosstalk at a time of audio playback, the method comprising:

passing a stereo audio signal through a crosstalk canceller, wherein the crosstalk canceller comprises a regularised inverse transfer function of an acoustic stereo playback path, wherein the crosstalk canceller has been regularised by aggregated frequency dependent regularisation parameters without band branching; and passing an output of the crosstalk canceller to stereo loudspeakers for acoustic playback.

According to a ninth aspect the present invention provides a non-transitory computer readable medium for reducing acoustic crosstalk at a time of audio playback, comprising instructions which, when executed by one or more processors, causes performance of the method of the third and/or eighth aspect of the invention.

According to a tenth aspect the present invention provides a device for reducing acoustic crosstalk at a time of audio playback, the device comprising;

a processor configured to pass a stereo audio signal through a crosstalk canceller, wherein the crosstalk canceller comprises a regularised inverse transfer function of an acoustic stereo playback path, wherein the crosstalk canceller has been regularised by aggregated frequency dependent regularisation parameters without band branching; and further configured to pass an output of the crosstalk canceller to stereo loudspeakers for acoustic playback.

In some embodiments of the invention, the frequency dependent regularisation parameters are selected so that the crosstalk canceller is configured to provide for a different amount of crosstalk cancellation and spectral coloration in one part of the audio spectrum as compared to another part of the audio spectrum. For example, the frequency dependent regularisation parameters may in some embodiments be selected to be generally larger at high frequencies, so that the crosstalk canceller is configured to provide less crosstalk cancellation and less spectral coloration at high frequencies. Such embodiments recognise that human stereo perception cues predominantly consist of the respective time of arrival at the left and right ear at low frequencies (less than about 800 Hz), and also the amplitude at the left and right ear above around 1.6 kHz, but that above around 8 kHz typical audio signals carry little signal energy and thus relatively few stereo cues exist above around 8 kHz. Accordingly, the crosstalk canceller may be configured to provide less crosstalk cancellation above around 8 kHz as minimal stereo effect will be lost by doing so but the spectral coloration of such high frequencies can be reduced.

Preferred embodiments further provide the additional step of, or configure the acoustic crosstalk cancellation operator to also provide for, matching of loudspeaker frequency response so that the difference between the loudspeakers' respective frequency responses is minimal. Such embodiments recognise that an extent to which the loudspeaker frequency responses are mismatched imposes a corresponding limitation upon how effective crosstalk cancellation can be. In preferred such embodiments the matching of loudspeaker frequency response is preferably effected after or as a part of operation of the acoustic crosstalk canceller, as not performing such matching operation undesirably limits crosstalk cancellation efficacy and also corrupts audio quality. It is to be noted that the matching of loudspeaker frequency response in preferred embodiments of the invention need merely seek for the difference between the loudspeakers' respective frequency responses to be made to be minimal, but need not necessarily seek for the loudspeakers' respective frequency responses to be flattened across the audio band. Further, while the speakers may be phase mismatched and/or spectrally amplitude mismatched, phase mismatch in particular limits the efficacy of acoustic crosstalk cancellation so that providing for phase matching therefore is particularly beneficial in maximising the efficacy of the acoustic crosstalk cancellation.

The process of crosstalk canceller design may be performed more than once in respect of a given device, for example in relation to each of a plurality of expected use modes of the device. For example, a first crosstalk canceller may be designed and stored in the device in respect of landscape video playback, and a second crosstalk canceller may be designed and stored in the device in respect of portrait video playback, with selection of the appropriate crosstalk canceller being made at the time of video playback based on whether the device is being held in a portrait or landscape position. A third crosstalk canceller design may be stored in the device in respect of audio-only playback while the device is face up on a table in front of the listener. The geometries of each use mode may be defined as appropriate in order to design the respective crosstalk canceller, for example for video playback by a compact device such as a tablet or smartphone it may be assumed that the device is 40 cm in front of the viewer's face with a screen of the device facing the viewer.

Some embodiments of the invention may further provide for crosstalk canceller design in relation to a device in which the speakers have unequal directivity, whether by virtue of speaker position upon the device and/or by virtue of the speakers having unequal acoustic output characteristics. Such embodiments may accommodate the unequal speaker directivity by deriving a directionality matrix representing the directivity gains from each speaker to each ear, as applicable in the respective assumed playback geometry. For example complex-valued directivity gains $b_{ij}$ (jω) associated with the respective contralateral and ipsilateral paths may be used to construct a directionality matrix B as follows:

$$B = \begin{bmatrix} b_{LL}(j\omega) & b_{LR}(j\omega) \\ b_{RL}(j\omega) & b_{RR}(j\omega) \end{bmatrix}$$

where i=L(eft) or R(ight) ear canal, j=L(eft) or R(ight) loudspeaker.

The complex-valued directivity gains may in some embodiments be measured by frequency sweeping from DC to the applicable Nyquist frequency from the respective speaker, and recording it by a reference microphone in the respective left or right ear of a head and torso simulator (HATS), for each propagation path. Additionally or alternatively, complex-valued directivity gains may be estimated by playing white noise from the respective speaker, and recording it by a reference microphone in the respective left or right ear of a HATS, for each propagation path, and performing system identification using any suitable method such as converging an adaptive filter. The complex-valued directivity gains in some embodiments may be smoothed across the audio band, normalised, and/or phase-aligned.

The left and right channel signals or multichannel signals may have been retrieved from an audio storage device. Alternatively, the left and right channel signals may be live or practically live signals, such as stereo audio captured during a video conference. The signals may be natural stereo signals captured by suitably positioned microphones relative to the recorded sound source, or may be artificial stereo signals conveying an artificial stereo field produced by artificial amplitude and delay control of each respective signal, or a combination of natural and artificial stereo signals as may be produced by stereo widening.

Accordingly, in some embodiments, the purpose of the proposed crosstalk cancellation method is to make the sound at the listener's ears as close to the original audio signal as possible, but only to within a certain deliberate margin, in order to trade off a perfect stereo effect to maintain spectral coloration within tolerable ranges. This is done by finding a matrix or operator to serve as the crosstalk canceller and which, when applied on to the original stereo audio signal prior to speaker playback, substantially cancels the impact of the directional channel, at least at the listener's location. Preferred embodiments further configure the matrix or operator such that a discrepancy in the loudspeakers' directionality is also substantially cancelled, all while maintaining spectral coloration within tolerable ranges.

BRIEF DESCRIPTION OF THE DRAWINGS

An example of the invention will now be described with reference to the accompanying drawings, in which.

DESCRIPTION OF THE PREFERRED EMBODIMENTS

Figure 1:
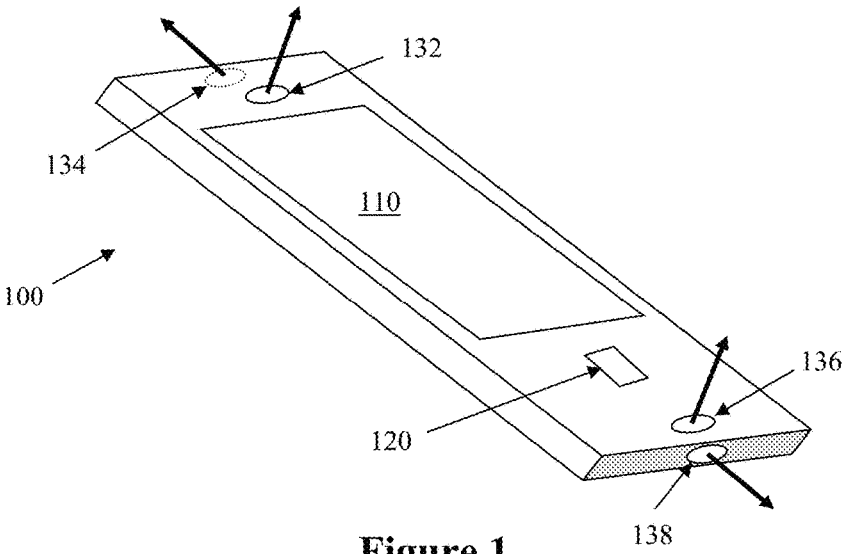
FIG. 1 illustrates a handheld device in respect of which the method of the present invention may be applied.

FIG. 1 illustrates a portable device 100 with touchscreen 110, button 120 and a plurality of loudspeakers 132, 134, 136, 138. The following embodiments describe the playback of audio using such a device, for example to accompany a video playback. As indicated, speakers 132 and 136 are both mounted in ports on a front face of the device 100. Thus, speakers 132 and 136 exhibit a directionality indicated by the respective arrow, each being at a normal to a plane of the front face of the device. In contrast, speakers 134 and 138 are mounted in ports on opposed end surfaces of the device 100. Thus the nominal directionality of speaker 134 is anti-parallel, i.e. 180°, to that of speaker 138, and perpendicular, i.e. 90°, to that of speakers 132 and 136. Other devices may have one or more speakers mounted elsewhere on the device and as described in the following such other devices may also be configured to deliver embodiments of the present invention. The following embodiments describe the playback of audio using the onboard speakers of such a device, for example to accompany a video playback, for music playback or for generally any stereo audio playback.

The aim of an acoustic crosstalk canceller (XTC) is to cancel the contralateral audio signals while delivering audio from the ipsilateral loudspeakers to a listener's ears, thereby providing the listener with an accurate binaural image and retain stereo cues.

Figures 2A, 2B:
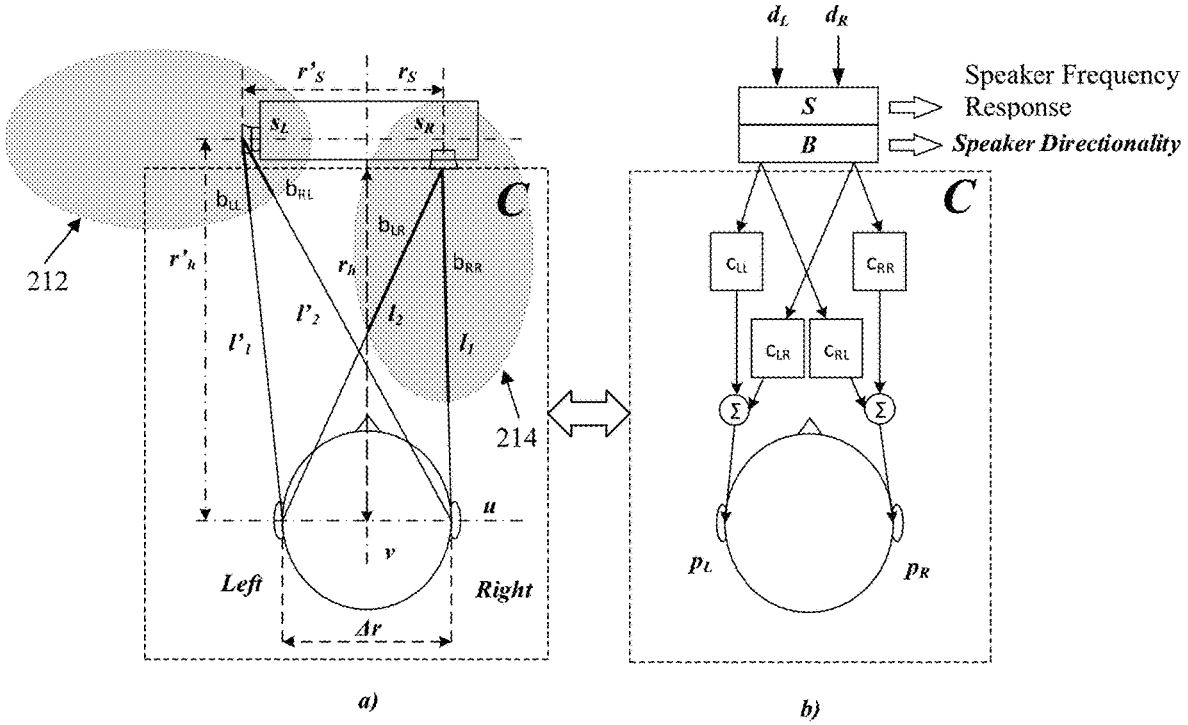
FIG. 2*a* portrays the geometry of the generalised two-channel playback system.
FIG. 2*b* shows its equivalent spatial channel model.

We first describe crosstalk cancellation for a generalised playback system, being a system in which it is assumed that two non-identical speakers are used, and further in which it is assumed that the respective speaker directionalities are unequal. The geometry and model of the generalised playback system is as follows. FIG. 2*a* shows the geometry of the generalised two-source soundwave propagation model. In this figure, $l_1$ and $l_2$ are the path lengths between the right source and the ipsilateral and contralateral ear respectively, and $l'_1$ and $l'_2$ are the path lengths between the left source and the ipsilateral and contralateral ear respectively; Δr is the effective distance between the ear canal entrances; u is the axis connecting the ear canals; axis v which is normal to axis u and passes through the interaural mid-point, divides the playback device so that the distance between the division point and the right and left speakers is $r_S$ and $r'_S$ respectively; $r_h$ is the shortest distance between the axis u and the right loudspeaker; $r'_h$ is the shortest distance between the axis u and the left loudspeaker. It should be noted that the loudspeaker naming is nominal, so the right loudspeaker may be called left, and vice-versa. Also, the model shown in FIG. 2*a* is asymmetric, so generally $l_1$ is not equal to $l'_1$, $l_2$ is not equal to $l'_2$, and $r_h$ is not equal to $r'_h$. Ellipses 212, 214 represent directivity patterns of the respective loudspeaker, so that the directivity of the left loudspeaker, $s_L$, is represented by complex gains $b_{LL}$ and $b_{RL}$ (shown in bold lines); and the directivity of the right loudspeaker, $s_R$, is represented by complex gains $b_{LR}$ and $b_{RR}$ (also shown in bold lines).

All specified geometric parameters of the playback model collectively define a spatial channel transfer function (CTF), C, which fully describes relations between the source (loudspeakers) and the sink (ear canals) of the generalised playback model. These relations are assumed to be linear so that for any chosen path, the CTF only changes amplitude and delay of the emitted soundwave.

The described generalised soundwave propagation model may be represented as a typical two input-two output ("2×2") system, as depicted in FIG. 2*b*. Its internal structure is known, and the corresponding component filters $c_{ij}$ (here and further on i=L(eft) or R(ight) ear canal, j=L(eft) or R(ight) loudspeaker) are linear and fully defined by, and therefore can be calculated from, the model geometry and as a result the component filters are assumed to be known a priori (as discussed further in the following, including in relation to FIG. 9).

In order to derive a XTC for the generalised playback system of FIGS. 2*a* and 2*b*, it is convenient to describe the system input-output (speaker to ear) relation in vector form as follows. Let $d_L$ and $d_R$ be a jω-th frequency component of the audio on the left and right channels of a stereo recording respectively; j indicates the presence of phase relations in the equation, ω=2πf and f is spectral frequency. Also let $p_L$ and $p_R$ be a jω-th frequency component of the audio on the left and right ear canal respectively.

The stereo digital audio signal $\vec{d}=[d_L\ d_R]T$ is passed through the system analog front-end and loudspeakers $s_L$ and $s_R$ with combined frequency response S, which in the case of perfect left and right audio channel decoupling can be expressed as follows.

$$S = \begin{bmatrix} s_L(j\omega) & 0 \\ 0 & s_R(j\omega) \end{bmatrix}. \quad \text{(EQ 1)}$$

In Equation 1 $s_L$ (jω) and $s_R$ (jω) are complex-valued frequency responses of the left and right analog front-end and loudspeaker respectively. Herein, $s_L$ (jω) and $s_R$ (jω) will be called loudspeaker frequency responses, and an analog front-end is implied. The directionality of each speaker, $s_L$ and $s_R$, along ipsilateral paths $l_1$ and $l'_1$, and contralateral paths $l_2$ and $l'_2$ as shown in FIG. 2*a*, is represented by a matrix B.

$$B = \begin{bmatrix} b_{LL}(j\omega) & b_{LR}(j\omega) \\ b_{RL}(j\omega) & b_{RR}(j\omega) \end{bmatrix}. \quad \text{(EQ 2)}$$

In Equation 2, $b_{ij}$ (jω) are complex-valued directivity gains along the left and right ipsilateral paths $l_1$ and $l'_1$, and the corresponding contralateral paths $l_2$ and $l'_2$. One method of obtaining the directionality matrix B is by measuring four frequency responses along the propagation paths $l_1$, $l_2$, $l'_1$, and $l'_2$: two for each ipsilateral path, $l_1$, and $l'_1$; and two for each contralateral path, $l_2$ and $l'_2$-$b_{RR}$ (jω), $b_{LL}$ (jω), $b_{LR}$ (jω), and $b_{RL}$ (jω) respectively for all frequencies jω. Each frequency response $b_{ij}$(jω) may be measured by frequency sweeping (DC to the Nyquist frequency) from the left or right speaker, and recording it by a reference microphone in the left or right ear of the HATS, depending on the propagation path being identified. See also FIG. 9. Alternatively, the frequency responses $b_{ij}$(jω) may be estimated by playing white noise from the corresponding speaker, and recording it by the corresponding reference microphone. Then the source and recorded audio signals can be used to perform system identification using any state-of-the-art method. One such state of the art system identification method is based on using an adaptive filter which uses the recorded signal as an input and the source signal as a reference. After convergence, the adaptive filter represents the system impulse response, which is easily converted into the system frequency response.

Further, the magnitude response $|b_{ij}(j\omega)|$ of the frequency responses $b_{ij}$(jω) are smoothed across the entire frequency band, and normalised so that the largest $|b_{ij}(j\omega)|=1$, and therefore the remaining three amplitude responses are less than unity. Then, the common phase shift is removed from all $b_{ij}$(jω). Propagation gains and delays due to discrepancies between the paths l1, l2, and l'1 and l'2 are also removed from $b_{LR}$ (jω) and $b_{RL}$(jω) so that the channel frequency response is removed from the measurements. It should be noted, that the frequency dependent directivity gains, $b_{ij}$(jω), may be reduced to correspondent scalar (frequency independent) gains and delays depending on required precision of directivity compensation. The overall input-output equation (the "speaker-to-ear" transfer function) can thus be expressed as follows:

$$\vec{p} = C^{\circ} BS\vec{d} \quad \text{(EQ 3)},$$

where ° is the Hadamard (element-wise) matrix multiplication, $\vec{p}=[p_L\ p_R]^T$, and C is a 2×2 channel frequency response:

$$C = \begin{bmatrix} c_{LL}(j\omega) & c_{LR}(j\omega) \\ c_{RL}(j\omega) & c_{RR}(j\omega) \end{bmatrix}. \quad \text{(EQ 4)}$$

It is convenient to introduce a directional channel model, $\tilde{C}$, such that $$\tilde{C} = C \circ B = \begin{bmatrix} c_{LL}(j\omega) & c_{LR}(j\omega) \\ c_{RL}(j\omega) & c_{RR}(j\omega) \end{bmatrix} \circ \begin{bmatrix} b_{LL}(j\omega) & b_{LR}(j\omega) \\ b_{RL}(j\omega) & b_{RR}(j\omega) \end{bmatrix} = \begin{bmatrix} c_{LL}(j\omega)b_{LL}(j\omega) & c_{LR}(j\omega)b_{LR}(j\omega) \\ c_{RL}(j\omega)b_{RL}(j\omega) & c_{RR}(j\omega)b_{RR}(j\omega) \end{bmatrix} = \begin{bmatrix} \tilde{c}_{LL}(j\omega) & \tilde{c}_{LR}(j\omega) \\ \tilde{c}_{RL}(j\omega) & \tilde{c}_{RR}(j\omega) \end{bmatrix}. \quad \text{(EQ 5)}$$

Substitution of EQ 5 into EQ 3 yields:

$$\vec{p} = \tilde{C}S\vec{d}. \quad \text{(EQ 6)}$$

The purpose of the proposed stereo enhancement method of the present invention is to seek to make the sound at the listener's ears $\vec{p}$ very close to the original audio signal $\vec{d}$, but only to within a certain margin. This is done by finding a matrix (operator) H, which when applied on to the original stereo audio signal $\vec{d}$, largely but not completely cancels the impact of the directional channel $\tilde{C}$. This is equivalent to cancelling both crosstalk and the discrepancy in the loudspeakers' directionality.

$$\vec{p} = \tilde{C}SH\vec{d}. \quad \text{(EQ 7)}$$

Matrix His the frequency response of the crosstalk canceller with component filters $h_{ij}$ (i=L(eft) or R(ight) ear canal, j=L(eft) or R(ight) loudspeaker):

$$H = \begin{bmatrix} h_{LL}(j\omega) & h_{LR}(j\omega) \\ h_{RL}(j\omega) & h_{RR}(j\omega) \end{bmatrix}. \quad \text{(EQ 8)}$$

In order for the crosstalk canceller to efficiently counteract the impact of the directional channel $\tilde{C}$, it is necessary to match frequency responses of the left and right loudspeakers, $s_L$ (jω) and $s_R$ (jω) respectively, so that the difference between the loudspeakers' frequency responses is minimal. The matching may be performed in a number of ways. For example, if the frequency response of the right loudspeaker is to be matched to the frequency response of the left loudspeaker, a filter $$s_{\bar{R}}(j\omega) = \frac{s_L\ (j\omega)}{s_R\ (j\omega)} \quad \text{(EQ 9)}$$

will be applied on to the frequency response of the right loudspeaker:

$$\tilde{s}_R(j\omega) = s_{\bar{R}}(j\omega) \cdot s_R(j\omega) \approx s_L(j\omega) \quad \text{(EQ 10)},$$

where $\tilde{s}_R$ (jω) is the frequency response of the right loudspeaker after matching it to the frequency response of the left loudspeaker.

Conversely, if the frequency response of the left loudspeaker is to be matched to the frequency response of the right loudspeaker, a filter $$s_{\bar{L}}(j\omega) = \frac{s_R\ (j\omega)}{s_L\ (j\omega)} \quad \text{(EQ 11)}$$

will be applied on to the frequency response of the left loudspeaker:

$$\tilde{s}_L(j\omega) = s_{\bar{L}}(j\omega) \cdot s_L(j\omega) \approx s_R(j\omega) \quad \text{(EQ 12)},$$

where $\tilde{s}_L$ (jω) is the frequency response of the left loudspeaker after matching it to the frequency response of the right loudspeaker.

In other embodiments, it is possible to match frequency responses of both left and right speakers to a frequency response of a user-defined or otherwise predefined frequency response. The matching filter derivation and the matching procedure is similar to the ones described above.

The above-described process of loudspeaker matching is convenient to represent in matrix form. Let $s_{\bar{L}}(j\omega)$ and $s_{\bar{R}}(j\omega)$ be frequency responses of the left and right matching filters respectively, combined into a matrix S such that:

$$\tilde{S} = \begin{bmatrix} s_{\bar{L}}(j\omega) & 0 \\ 0 & s_{\bar{R}}(j\omega) \end{bmatrix}. \quad \text{(EQ 13)}$$

The loudspeaker matching is achieved by applying S on the output of the crosstalk canceller so that EQ 7 yields:

$$\vec{p} = \tilde{C}S\tilde{S}H\vec{d}. \quad \text{(EQ 14)}$$

where $$S\tilde{S} = \begin{bmatrix} s_L(j\omega) & 0 \\ 0 & s_R(j\omega) \end{bmatrix} \begin{bmatrix} s_{\bar{L}}(j\omega) & 0 \\ 0 & s_{\bar{R}}(j\omega) \end{bmatrix} = \begin{bmatrix} s_L(j\omega)s_{\bar{L}}(j\omega) & 0 \\ 0 & s_R(j\omega)s_{\bar{R}}(j\omega) \end{bmatrix} = \begin{bmatrix} \tilde{s}(j\omega) & 0 \\ 0 & \tilde{s}(j\omega) \end{bmatrix} = \tilde{s}(j\omega)\begin{bmatrix} 1 & 0 \\ 0 & 1 \end{bmatrix} = \tilde{s}(j\omega) \quad \text{(EQ 15)}$$

where $\tilde{s}$(jω) is the frequency response of both loudspeakers after matching.

Substituting EQ 15 into EQ 14 yields:

$$\vec{p} = \tilde{s}\tilde{C}H\vec{d}. \quad \text{(EQ 16)}$$

From EQ 16 it follows that the performance of the proposed playback system depends on the choice of the crosstalk canceller. For example, in theory, perfect cancellation is achieved when the XTC is the inverse of the directional channel frequency response, or:

$$H = \tilde{C}^{-1} \quad \text{(EQ 17)}.$$

Substitution of EQ 17 into EQ 16 gives $$\vec{p} = \tilde{s}\tilde{C}H\vec{d} = \tilde{s}\tilde{C}\tilde{C}^{-1}\vec{d} = \tilde{s}\vec{d}. \quad \text{(EQ 18)}$$

Therefore, in theory, after perfect crosstalk cancellation the audio at the listener's ears is precisely the same as the original audio signal spectrally shaped by the frequency response of the matched loudspeakers. However in practice if the XTC is set to be the inverse of the directional channel frequency response in accordance with EQ 17, a highly sensitive and in fact impractical system results.

Figure 3:
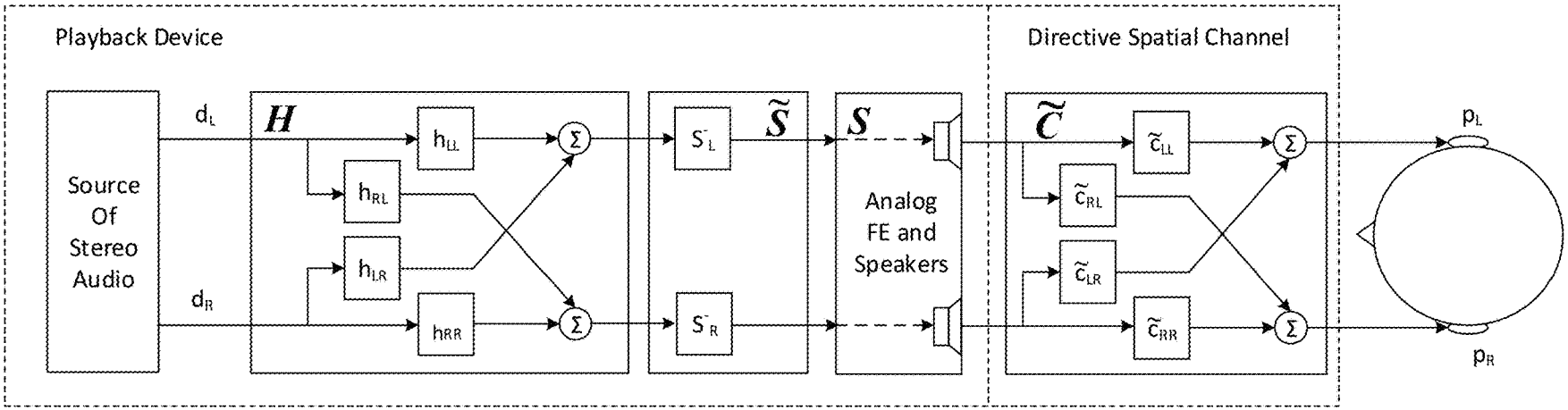
FIG. 3 illustrates the crosstalk canceller, H, and its place in the overall generalized playback system.

FIG. 3 illustrates an example of a crosstalk canceller, H, in accordance with one embodiment of the present invention, and its place in the overall generalised playback system. A digital stereo audio signal $\vec{d}$ represented by left and right channels $d_L$ and $d_R$ from a source of stereo audio is fed into the crosstalk canceller, H. The crosstalk canceller applies the component filters $h_{ij}$ according to the two input-two output structure. The XTC output is applied with loudspeaker frequency response matching filters, $\tilde{S}$, and then D/A converted, spectrally shaped, amplified in the Analog Front-End and output to the corresponding loudspeakers S. The speaker outputs propagate through the directional channel $\tilde{C}$, which is equivalent to passing the audio signal through the two input-two output structure with component filters $\tilde{c}_{ij}$. The component filters $\tilde{c}_{ij}$ of the spatial channel $\tilde{C}$ are fully determined by the playback geometry and directionality of the speakers (FIGS. 2*a* and 2*b*), whereas the component filters of the crosstalk canceller, $h_{ij}$, are chosen such that the crosstalk component of the audio signal that arrives at the listener's ears, $\vec{p}$, is desirably attenuated.

As noted above, in practice if the XTC is set to be the exact inverse of the directional channel frequency response in accordance with EQ 17, a highly sensitive and impractical system results. Accordingly, the present invention seeks to provide a robust crosstalk canceller. In order to introduce such a canceller, the following considerations are necessary.

First, for a given playback system and geometry, the performance of the XTC is fully determined by the choice of H.

Second, to provide a robust practical solution it is necessary to avoid perfect crosstalk cancellation as per EQ 17. This is because while in theory it totally removes crosstalk, in practice the performance of this method is highly sensitive to the listener's head position, results in excessive spectral coloration, and adds a substantial load on both transducers. When geometry of the playback is violated (e.g. the listener moves his head left or right with respect to the centre of the playback device), the effect of crosstalk cancellation is severely deteriorated, and the spectral coloration causes unpleasant sound distortion.

Third, the severity of spectral coloration caused by the designed crosstalk canceller can be fully determined by a suitable method of deriving H, in accordance with the present invention. However some such methods allow a special parameterisation, which enables a trade-off between maximal spectral coloration, achievable crosstalk cancellation, and the size of the "sweet spot", being the three dimensional volume within which maximum or sufficient crosstalk cancellation occurs and within which minimal or tolerable audible spectral coloration is perceived.

Fourth, the performance of the XTC is sensitive to the position of the listener's head. By controlling spectral coloration in a trade off against the amount of perceived binaural cues it is possible to reduce perceived distortion arising in response to head movement.

Fifth, the performance of the crosstalk canceller will progressively degrade with increasing discrepancy between the loudspeakers' frequency responses. Discrepancy in the phase responses is more damaging to the XTC, than discrepancy in the magnitude responses. For this reason, in order to maximise the obtainable beneficial effect of crosstalk cancellation, in some embodiments we propose that the frequency responses of both loudspeakers are to be matched to each other, as per EQ 15. This matching may be advantageous in compact playback devices or indeed in any system in which relatively low cost, and thus poorly matched, speakers are employed. Embodiments deployed on devices having sufficiently well matched loudspeakers may however omit this step.

Sixth, the performance of the crosstalk canceller will deteriorate if the loudspeakers have different directionality patterns. Such differences in directionality may arise due to a difference in the loudspeaker design, a difference in the loudspeaker port design, placement of the loudspeakers on non-parallel or orthogonal surfaces of the device (as shown in FIGS. 1 and 2*a*), or otherwise. In order to improve the performance of the crosstalk canceller, the directivity patterns of both loudspeakers are preferably compensated for in embodiments where this problem occurs. In the following described embodiment of the invention a measured loudspeaker directivity pattern is incorporated into the channel frequency response (as per EQ 5) so as to derive an XTC which simultaneously cancels crosstalk and also compensates for the loudspeakers' difference in directivity.

With particular regard to the first to fourth considerations above, the present invention provides for crosstalk canceller regularisation in order to introduce a controllable trade-off between residual crosstalk and spectral coloration. The described embodiments effect a frequency dependent regularisation using an aggregated regularisation parameter, however other types of regularisation may be used. The described embodiment further extends this method to a more general case of asymmetric playback geometry, and solves the XTC problem for a more general case with speaker directivity, while also significantly simplifying the method such that most of its complexity lies in off-line design of the XTC, H, and so that on-line (run-time) complexity is minimised, to allow deployment on compact mobile devices and the like. To this end, the XTC is expressed as follows. The frequency response of the crosstalk canceller is calculated as follows.

$$H=[C^{H}C+R]^{-1}C^{H} \quad \text{(EQ 19)},$$

where R is a frequency dependent regularisation matrix, such that:

$$R=\begin{bmatrix} \rho^{L}(\omega,\Gamma^{L}) & 0 \\ 0 & \rho^{R}(\omega,\Gamma^{R}) \end{bmatrix}, \quad \text{(EQ 20)}$$

where $\Gamma^L$ and $\Gamma^R$ are the required levels of spectral coloration, at the left and right loudspeakers respectively, $\rho^L(\omega,\Gamma)$ and $\rho^R(\omega,\Gamma)$ are the aggregated frequency-dependent regularisation parameters used to achieve required spectral coloration at the left or right loudspeakers, respectively, such that $$\rho^{L}(\omega,\Gamma^{L})=\max\{(\rho_{I}^{L}(\omega,\Gamma^{L}),\rho_{II}^{L}(\omega,\Gamma^{L}),0\}, \quad \text{(EQ 21)}$$

$$\rho^{R}(\omega,\Gamma^{R})=\max\{(\rho_{I}^{R}(\omega,\Gamma^{R}),\rho_{II}^{R}(\omega,\Gamma^{R}),0\}. \quad \text{(EQ 22)}$$

The regularisation sub-parameters $\rho_I$ and $\rho_{II}$ may be calculated using a method described in U.S. Pat. No. 9,167,344, or by any other suitable method. It is to be noted that U.S. Pat. No. 9,167,344 uses the regularisation sub-parameters $\rho_I$ and $\rho_{II}$ in a manner unlike that of the present embodiment of the invention, by using a band branching method which requires the input audio to be divided into sub-bands whose widths are dependent on the playback system parameters (e.g. playback geometry, sampling frequency), and then processing each such band separately by a respective XTC designed specifically for each band using a respective regularisation parameter, which is complex with high MIPS and memory requirements. In contrast, the present embodiment of the invention uses the regularisation sub-parameters $\rho_I$ and $\rho_{II}$ to produce aggregated regularisation parameters $\rho^L$ and $\rho^R$ which importantly permits crosstalk cancellation to be effected without the use of band branching, requiring only a single XTC design.

Figure 4A:
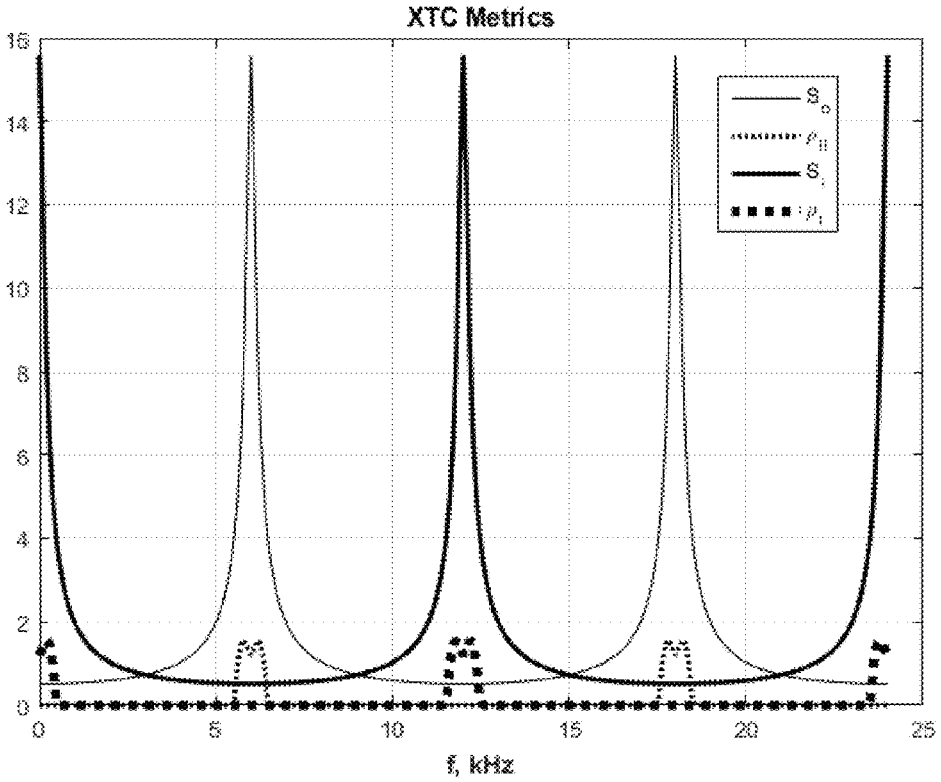
FIGS. 4*a* and 4*b* illustrate the profile of an unregularised crosstalk canceller response, and the unregularised response peak alignment with regularisation parameter peaks.
Figure 4B:
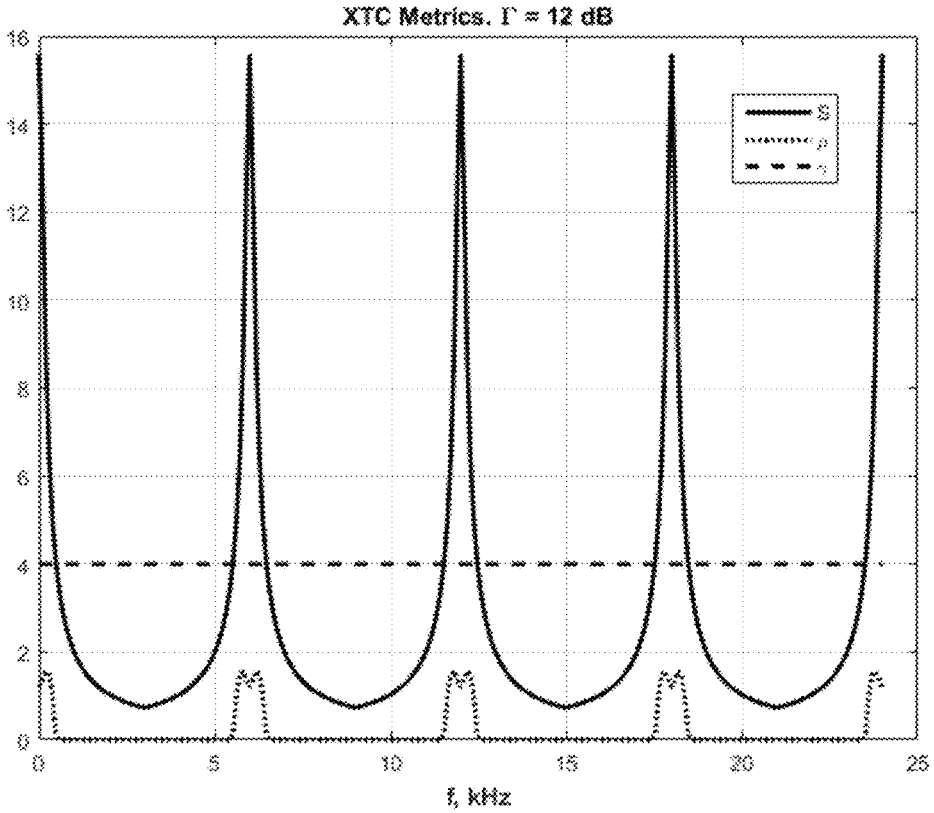

In order to derive the desired aggregated regularisation parameters, the present embodiment of the invention recognises that peaks of the unregularised in-phase XTC response $S_i(\omega)$ (where $S_i(\omega)=|h_{LL}(j\omega)+h_{LR}(j\omega)|=|h_{RL}(j\omega)+h_{RR}(j\omega)|$) always coincide in frequency with peaks of the FDR parameter $\rho_I$. It was further recognised that peaks of the unregularised out-of-phase XTC response $S_o(\omega)$ (where $S_o(\omega)=|h_{LL}(j\omega)-h_{LR}(j\omega)|=|h_{RL}(j\omega)-h_{RR}(j\omega)|$) always coincide in frequency with peaks of the FDR parameter $\beta_{II}$. This coincidence is illustrated in FIG. 4*a*, calculated for fs=48 kHz and Γ=12 dB ($\gamma=10^{\Gamma/20}=3.98$), and in which ρ is scaled up by a factor or 100 for comparison purposes. Note, that the FDR parameter ρ cannot take negative values, i.e. $0\leq\rho<1$, so its negative values for both $\rho_I$ and $\rho_{II}$ can be discarded (set to zero). Since $\hat{S}(\omega)=\max[S_i(\omega), S_o(\omega)]$, the peaks of $\hat{S}(\omega)$ will coincide with the peaks of an aggregated parameter $\rho=\max(\rho_I,\rho_{II},0)$ (FIG. 4*b*), therefore regularisation will as desired only occur at the frequencies where $\hat{S}(\omega)\geq\gamma$. By calculating aggregated frequency dependent regularisation parameters by way of such aggregation, band branching and the complexity associated with it are avoided, which significantly simplifies implementation of the XTC. It is to be noted that aggregation may be performed in any other suitable manner and other such aggregation methods of calculating aggregated frequency dependent regularisation parameters are within the scope of the present invention.

In (EQ 19) all components are frequency dependent. For every jω-th spectral frequency, the crosstalk canceller is represented as a 2×2 matrix, H, as per EQ 8, and each matrix H consists of four component filters as described earlier.

Although it is in the general case possible to achieve different spectral coloration at each loudspeaker, in this treatment, without loss of generality, we will consider a case, where the same spectral coloration is required at both left and right loudspeakers, so $\Gamma=\Gamma^L=\Gamma^R$ is a scalar.

A particular recognition of some embodiments of the present invention is that the spectral coloration caused by the frequency response, H, of the crosstalk canceller is an undesired artefact, particularly in high frequencies. Accordingly, here we propose a method of frequency selective control of spectral coloration caused by XTC, which allows reduced spectral coloration in any chosen frequency band, different to the coloration permitted in other bands. The method is as follows. If designed using EQ 19, the XTC introduces an amount of spectral coloration, Γ, that is inversely proportional to the regularisation parameter ρ: the smaller rho, the larger the spectral coloration, and with ρ=0, the spectral coloration is maximal. Therefore it is possible to decrease spectral coloration by making a controlled increase in the regularisation parameter, ρ.

Hence, one method of frequency selective control of the spectral coloration is to apply a "shaping" function on to the allowed spectral coloration, Γ. This function may be, but is not limited to, the "flipped" logistic function:

$$L(n) = \frac{\Gamma}{1 + e^{k(n-n_0)}} \quad \text{(EQ 23)}$$

where e is the natural logarithm base, n is n-th DFT frequency bin, no is the DFT frequency bin corresponding to the sigmoid's midpoint, F is the allowed spectral coloration (the sigmoid's maximum value), and k is the slope (steepness) of the curve.

Figure 7A:
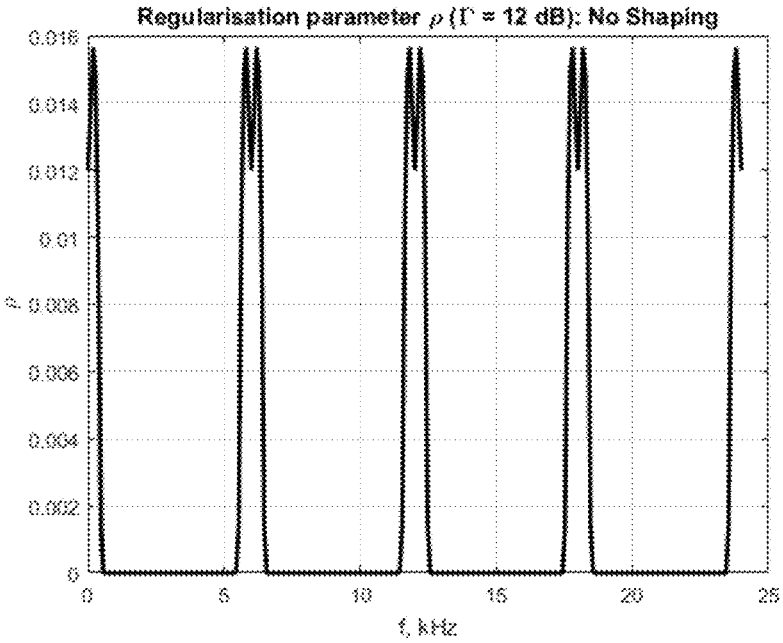
FIGS. 7*a*, 7*b*, 7*c*, and 7*d* illustrate the values taken by frequency dependent regularisation parameters across the audio spectrum in accordance with various embodiments of the present invention.

FIG. 7*a* shows an example of original regularisation parameter ρ as may be used in some embodiments not effecting frequency selective control of the spectral coloration. To provide frequency selective control of the spectral coloration, the parameter ρ profile of FIG. 7*a* can simply be shaped to generally take larger values at higher frequencies, to yield the variant shown in FIG. 7*c*. Noting the y-axis values of FIG. 7, the shaping involves p becoming more than 10 times larger at high frequencies in FIG. 7*c* as compared to FIG. 7*a*.

Figure 7B:
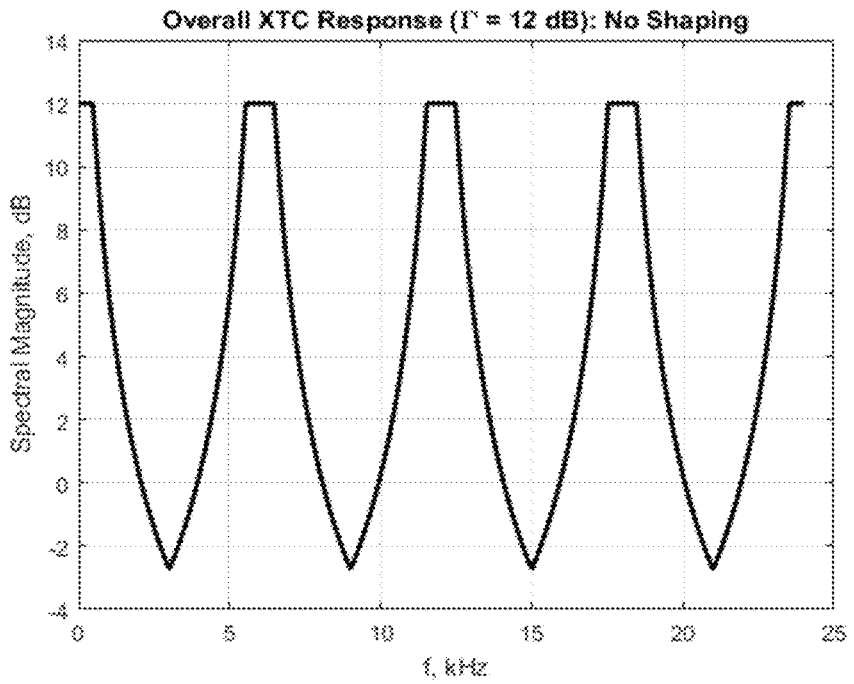
Figure 7C:
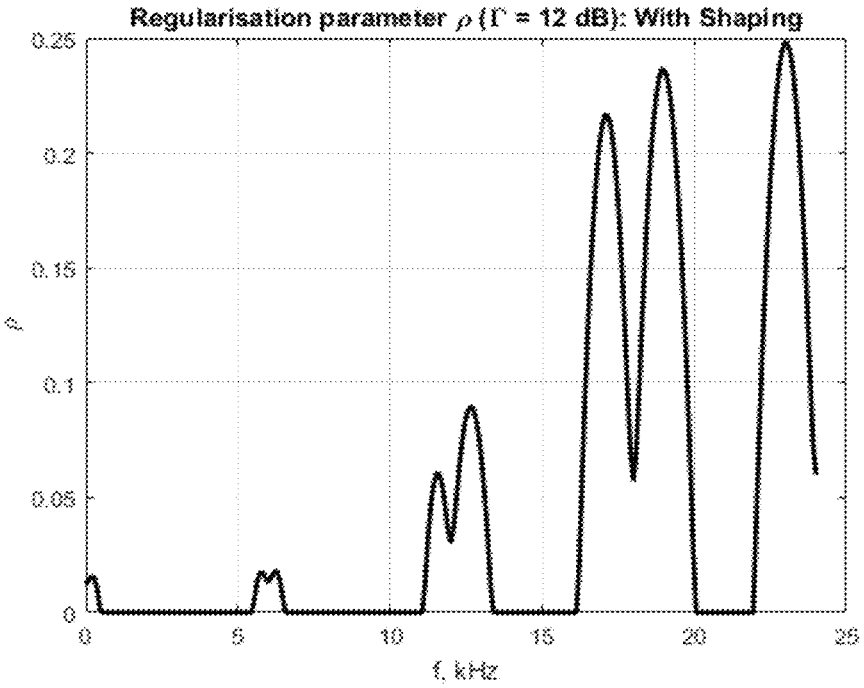
Figure 7D:
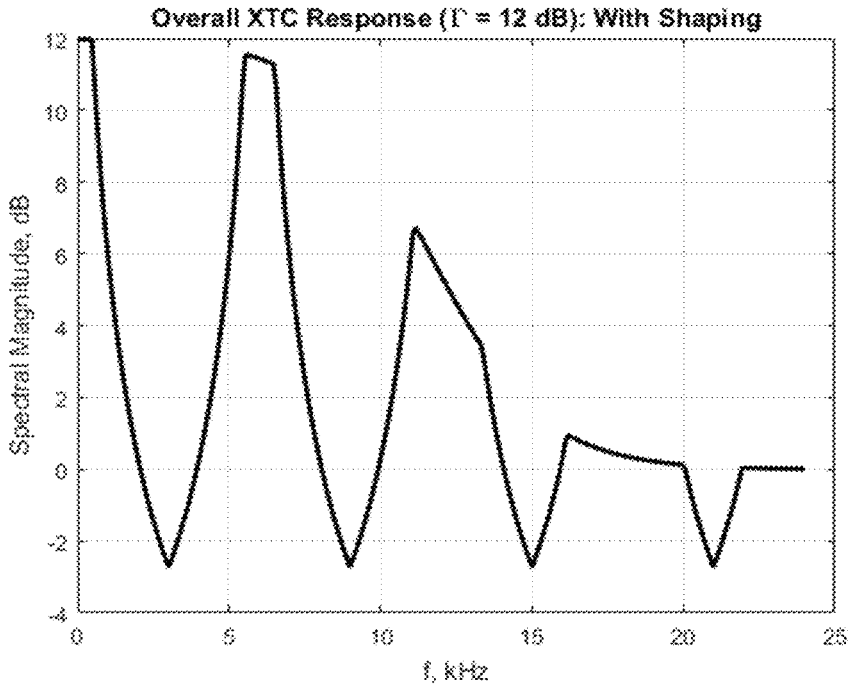

FIG. 7*b* represents the combined frequency response of the XTC using the values of p from FIG. 7*a*. FIG. 7*d* shows the combined frequency response of the XTC after the frequency selective control (shaping) of the spectral coloration has been applied as per FIG. 7*b*. Note, the values of p have been selected to enforce a maximum value of allowed spectral coloration, F=12 dB. It may be seen that the shaping visible in FIGS. 7*b* and 7*d* causes a sigmoidal roll-off decrease in spectral coloration at the high frequencies, e.g. spectral coloration is halved at the frequency of 11 kHz and continues to reduce up to the Nyquist frequency (24 kHz in this embodiment). It is to be noted that FIG. 7*d* illustrates the maximal amount of spectral coloration which will be produced by the system when playing back an audio signal. This does not imply that filtering has been applied to the audio signal nor to the frequency response of any component filter of the XTC. The frequency selective control occurs as a result of the FIG. 7*b* "shaping" of the regularisation parameters used to derive the crosstalk canceller (by EQ 19). Moreover, while the present embodiment provides for a sigmoidal roll-off of the profile of the spectral coloration at high frequencies, any other suitable method or window of reducing the profile of the spectral coloration at high frequencies may be implemented, and any suitable cut-off frequency for such a roll-off may be selected as appropriate for a given application.

Accordingly, we can provide a method for XTC design for a generalised playback system. The proposed method of the XTC design is as follows. For a specific XTC use case, e.g. music video playback on a mobile phone, we define an input parameter vector $\vec{u}=[r_S, r'_S, r_h, r'_h, \Delta r, \Gamma, n, f_S,]$, where Γ (dB) is the maximum allowed spectral coloration (cumulative gain due to crosstalk cancellation); n is the length of each component filter, and $f_S$ (Hz) is the sampling frequency.

Next, calculate the playback geometry parameters: path lengths $l_1$, $l_2$, $l'_1$, and $l'_2$:

$$l_1=l_{RR}=\sqrt{(0.5\Delta r-r_s)^2+r_h^2} \quad \text{(EQ 24)}$$

$$l_2=l_{LR}=\sqrt{(0.5\Delta r+r_s)^2+r_h^2} \quad \text{(EQ 25)}$$

$$l'_1=l_{LL}=\sqrt{(0.5\Delta r-r'_s)^2+r'^2_h} \quad \text{(EQ 26)}$$

$$l'_2=l_{RL}=\sqrt{(0.5\Delta r+r'_s)^2+r'^2_h} \quad \text{(EQ 27)}$$

where $l_{ij}$ is the path length to the i-th (L(eft) or R(ight)) ear canal from the j-th loudspeaker.

Next, calculate the channel parameters along each propagation path $l_1$, $l_2$, $l'_1$, and $l'_2$. In particular, calculate the path attenuations $g_1$, $g_2$, $g'_1$ and $g'_2$ as follows. Select the shortest path length $l_{min}=\min\{(l_1, l_2, l'_1, l'_2\}$ and set the gain across this path to unity, so that $g[l_{min}]=1$. Here, [A] denotes "index of A". The remaining gains are calculated as $$g_k = \frac{l_l}{l_{min}},\ k = [l_1], [l_2];\ k \neq [l_{min}] \quad \text{(EQ 28)}$$

$$g'_k = \frac{l'_k}{l_{min}},\ k = [l'_1], [l'_2];\ k \neq [l_{min}] \quad \text{(EQ 29)}$$

Thereby, the path gains $g_1=g_{RR}$, $g_2=g_{LR}$, $g'_1=g_{LL}$ and $g'_2=g_{RL}$ are estimated. Next, calculate the path delays in seconds, $\tau_C$ and path delays samples, $\tau_S$, along all propagation paths $l_1$, $l_2$, $l'_1$, and $l'_2$:

$$\tau_{Cl_1} = \frac{l_1}{c_S} \quad \text{(EQ 30)}$$

$$\tau_{Cl_2} = \frac{l_2}{c_S} \quad \text{(EQ 31)}$$

$$\tau_{Cl'_1} = \frac{l'_1}{c_S} \quad \text{(EQ 32)}$$

$$\tau_{Cl'_2} = \frac{l'_2}{c_S}. \quad \text{(EQ 33)}$$

Next, normalise the calculated path delays (in seconds) by selecting the shortest delay $\tau_{C\ min}$ and subtracting it from all delays in EQ 30-33, so that they become:

$$\tau_{Cl_1}=\tau_{CRR}=\tau_{Cl_1}-T_{C\ min} \quad \text{(EQ 34)}$$

$$\tau_{Cl_2}=\tau_{CLR}=\tau_{Cl_2}-T_{C\ min} \quad \text{(EQ 35)}$$

$$\tau_{Cl'_1}=\tau_{CLL}=\tau_{Cl'_1}-T_{C\ min} \quad \text{(EQ 36)}$$

$$\tau_{Cl'_2}=\tau_{CRL}=\tau_{Cl'_1}-T_{C\ min} \quad \text{(EQ 37).}$$

Normalised path delays (in samples) is $\tau_{Sl_1}=\tau_{SRR}$, $\tau_{Sl_2}=\tau_{SLR}$, $\tau_{Sl'_1}=T_{SLL}$, $\tau_{Sl'_2}=\tau_{SRL}$, are calculated by multiplying the corresponding path delays in samples (EQ 34-37) by the sampling frequency, $f_S$. Next, we construct the spatial channel impulse response, $C^t$. The spatial channel impulse response, $C^t$ is represented by four component filters, $c_{ij}^t$, where i=L, R is the designation of the left or right listener's ear, and j=L, R is the designation of the left or right loudspeaker. Each component filter, $c_{ij}^t$, is constructed by inserting corresponding path gains $g_{ij}$ (EQ 28-29) into the corresponding is $\tau_{S\ ij}$-th tap of an n-element zero vector. If is $\tau_S$ non-integer it may be rounded to a nearest integer. For example, for the $l'_1=l_{LL}$ path (to the listener's left ear from the left loudspeaker), if $g_{LL}$=0.985, is $\tau_{SLL}$=3 samples, and the component filter length is equal to 512 taps, the component filter, $c_{LL}^t$, is constructed by inserting 0.985 into the fourth tap of the 512-element zero vector.

Then, we construct the spatial channel frequency response, C, represented by its component filters $c_{LL}$, $c_{LR}$, $c_{RL}$, $c_{RR}$ by performing an n-point DFT on the $C^t$ component filters $c_{CL}^t$, $c_{LR}^t$, $c_{RL}^t$, $c_{RR}^t$. Next, we construct the directional channel frequency response, $\tilde{C}$, represented by its component filters $\tilde{c}_{LL}$, $\tilde{c}_{LR}$, $\tilde{c}_{RL}$, $\tilde{c}_{RR}$ by performing a Hadamard (element-wise) multiplication of the channel frequency response, C, on the speaker directionality matrix, B, as per EQ 5.

Next we calculate the crosstalk canceller frequency response, H. For a given spectral coloration level Γ dB we calculate the frequency-dependent regularisation parameters for each (left or right) side of the playback system, $\rho^L(\omega, \Gamma)$ and $\rho^R(\omega, \Gamma)$, respectively.

$$\rho^L(\omega)=\max\{\rho_I^L(\omega),\rho_I^L(\omega),0\}, \quad \text{(EQ 38)}$$

$$\rho^R(\omega)=\max\{\rho_I^R(\omega),\rho_{II}^R(\omega),0\}. \quad \text{(EQ 39)}$$

It is to be noted that this method for calculation of the regularisation parameters is generalised to a non-symmetric playback geometry, and it does not require band branching.

For each frequency ω assemble a matrix $C^\omega$ such that:

$$C^\omega = \begin{bmatrix} c_{LL}(j\omega) & c_{LR}(j\omega) \\ c_{RL}(j\omega) & c_{RR}(j\omega) \end{bmatrix} \quad \text{(EQ 40)}$$

For each frequency ω estimate the crosstalk canceller frequency response, $H^\omega$ as:

$$H^\omega = [C^{\omega(H)}C^\omega + R]^{-1}C^{\omega(H)} = \begin{bmatrix} h_{LL}(j\omega) & h_{LR}(j\omega) \\ h_{RL}(j\omega) & h_{RR}(j\omega) \end{bmatrix} \quad \text{(EQ 41)}$$

where superscript $^{(H)}$ represents the Hermitian conjugation operator, and the regularisation matrix is defined by EQ 20.

It is to be noted that regularisation occurs naturally at the frequencies where $\rho^k(\omega)>0$, k=L or R, which is where the magnitude frequency response of the unregularised XTC exceeds Γ dB. Otherwise, ordinary least-squares inversion is performed as there is no need for the regularisation.

Next we construct the XTC impulse response, $H^t$, represented by its component filters $h_{ij}^t$ by performing an n-point inverse DFT (IDFT) on the $H^\omega$ component filters $h_{ij}$ across all frequencies, followed by a cyclic shift of n/2. The calculated component filters coefficients $h_{ij}^t$ of the XTC are loaded into the two-input two-output filter structure H (FIG. 3).

Importantly, while derivation of the component filters coefficients $h_{ij}^t$ of the XTC H involves the above described process and entails a considerable computational burden, this is a one-off process which can be performed just once in respect of each expected use mode of the device 100. The component filters coefficients $h_{ij}^t$ of the XTC H do not necessarily require any further change thereafter throughout the entire lifetime of the device 100. The run-time computational burden of the presently described crosstalk canceller is much reduced as compared to the one-off design of the canceller, because the run-time process of stereo audio playback merely involves passing the input audio stereo signal d through H.

Figure 5A:
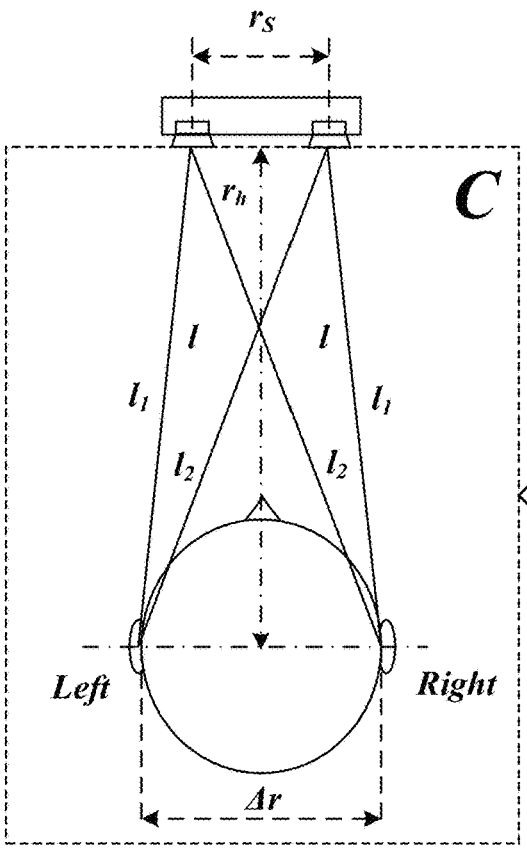
FIG. 5*a* illustrates the geometry of a two-channel free-field playback system with identical loudspeakers.

In another embodiment of the invention, the crosstalk canceller is designed for the case of crosstalk cancellation of a playback system having same plane placement of identical speakers. FIG. 5*a* shows the geometry of the two-source free-field soundwave propagation model of such an embodiment. In this figure, $l_1$ and $l_2$ are the path lengths between any of the two sources and the ipsilateral and contralateral ear respectively; Δr is the effective distance between the ear canal entrances, $r_S$ is the distance between the centres of the loudspeakers; $r_h$ is the distance between a point equidistant between the two ear canal entrances and a point equidistant between the two loudspeakers. It should be noted that the model is symmetric, so $l_1$ equals and $l_2$ are the same on each (left and right) side of the model.

Figure 5B:
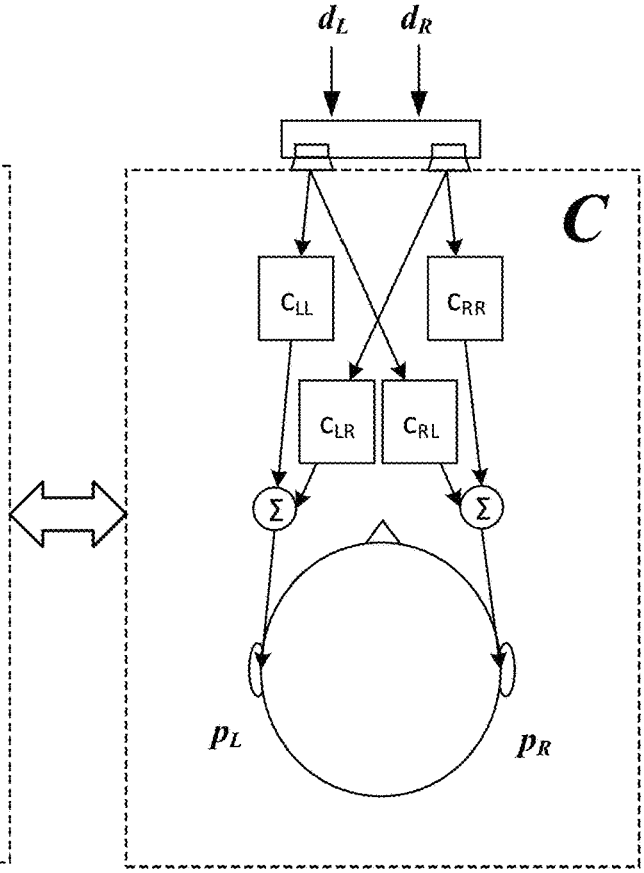
FIG. 5*b* illustrates the equivalent spatial channel model.

The described free-field soundwave propagation model may be represented as a typical two input-two output ("2×2") system, as depicted in FIG. 5*b*.

Figure 6:
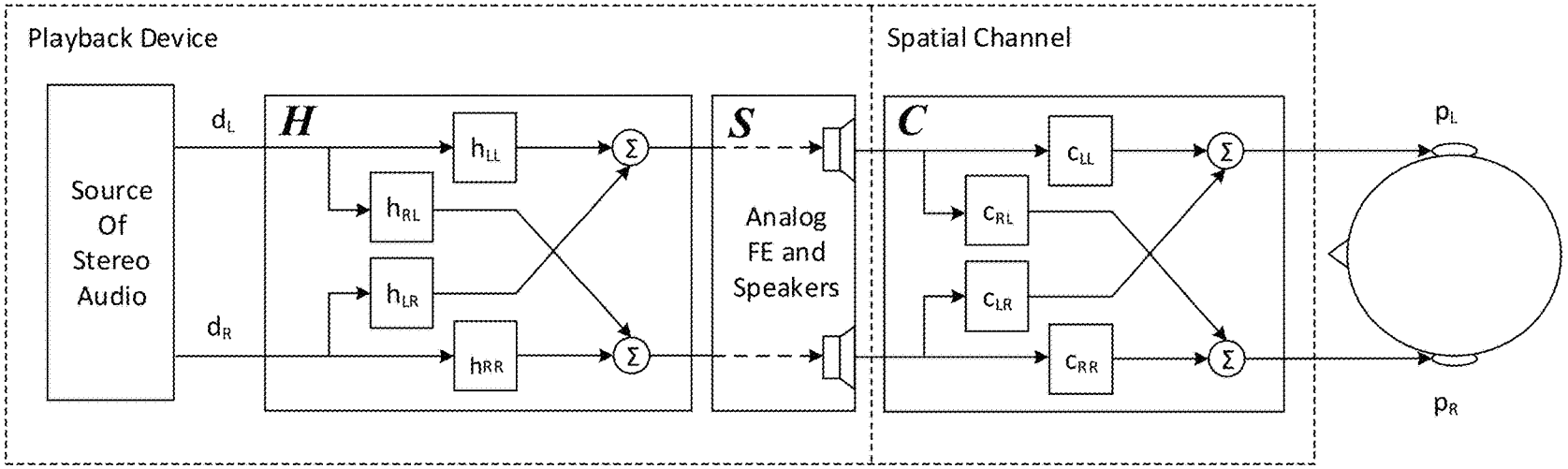
FIG. 6 illustrates the crosstalk canceller, H, and its place in the overall free-field playback system of FIG. 5.

FIG. 6 shows this embodiment of the crosstalk canceller, H, and its place in the playback system of FIG. 5. Analogous to the spatial channel model, C, the XTC is represented as a two input-two output system with corresponding component filters. Let $d_L$ and $d_R$ be jω-th frequency component of the audio on the left and right channels of a stereo recording respectively; and also let $p_L$ and $p_R$ be a jω-th frequency component of the audio on the left and right ear canal respectively. The stereo digital audio signal $d=[d_L\ d_R]T$ is passed through the system identical analog front-ends and loudspeakers, $s_L=s_R=s$, with combined frequency response S, which in the case of perfect left and right audio channel decoupling can be expressed as follows:

$$S = \begin{bmatrix} s_L(j\omega) & 0 \\ 0 & s_R(j\omega) \end{bmatrix} = \begin{bmatrix} s(j\omega) & 0 \\ 0 & s(j\omega) \end{bmatrix} = s(j\omega)I, \quad \text{(EQ 42)}$$

where s(jω) is a complex-valued frequency response of both left and right analog front-end and loudspeakers, and I is a 2×2 identity matrix.

In the case of identical and symmetrically placed loudspeakers, the speaker directionality matrix becomes $$B = \begin{bmatrix} 1 & 1 \\ 1 & 1 \end{bmatrix}. \quad \text{(EQ 43)}$$

After substituting EQ 42 and EQ 43 into EQ 3, the overall input-output equation for the symmetric free-field model can be expressed as follows.

$$\vec{p} = sC\vec{d} \quad \text{(EQ 44).}$$

Substituting EQ 17 into EQ 44 yields:

$$\vec{p} = sCH\vec{d} = \tilde{s}CC^{-1}\vec{d} = \tilde{s}\vec{d}. \quad \text{(EQ 45)}$$

Therefore, after perfect crosstalk cancellation, the audio at the listener's ears is, again only in theory, the original audio signal spectrally shaped by the frequency response of the matched loudspeakers.

Hence, as shown in FIG. 6, a digital stereo audio signal $\vec{d}$ represented by left and right channels $d_L$ and $d_R$ from the Source of Stereo Audio is fed into the crosstalk canceller, H. The crosstalk canceller applies the component filters $h_{ij}$ (EQ 2) according to the two input-two output structure. The XTC output, $H\vec{d}$, is then D/A converted, spectrally shaped, amplified in the Analog Front-End and output to the corresponding loudspeakers. The audio emitted from the loudspeakers propagates through the channel C, which is equivalent to passing the audio signal $sH\vec{d}$ through the two input-two output structure with component filters $c_{ij}$ (EQ 4). The component filters $c_{ij}$ of the spatial channel C are fully determined by the playback geometry (FIGS. 5*a* and 5*b*), whereas the component filters of the crosstalk canceller, $h_{ij}$, are chosen such that the crosstalk signal that arrives at each ear from the opposite loudspeaker is cancelled or severely attenuated.

Accordingly, for the case of symmetric placement of two identical loudspeakers, the proposed XTC is derived as follows. For each jω-th spectral frequency $$H = [C^H C + \rho I]^{-1} C^H \quad \text{(EQ 46)}$$

where $0 \le \rho < 1$ is an aggregated frequency-dependent regularisation parameter, I—identity matrix.

The proposed method of the XTC design for the embodiment of FIGS. 5 and 6 is as follows. For a specific XTC use case, e.g. music video playback on a mobile phone, we define an input parameter vector $\vec{u} = [r_S, r_h, \Delta r, \Gamma, n, f_S,]$, where Γ (dB) is the maximum allowed spectral coloration (gain applied by the component filter of the XTC); n is the length of component filters, and $f_S$ (Hz) is the sampling frequency. We calculate playback geometry parameters: $l_1$, $l_2$ and the path difference, Δl:

$$l_1 = \sqrt{(0.5\Delta r - r_s)^2 + r_h^2} \quad \text{(EQ 47)}$$

$$l_2 = \sqrt{(0.5\Delta r + r_s)^2 + r_h^2} \quad \text{(EQ 48)}$$

$$\Delta l = l_2 - l_1 \quad \text{(EQ 49)}$$

Next we calculate channel parameters, including the path attenuation g, the path delay in seconds $\tau_c$, and the path delay in samples $\tau_s$:

$$g = \frac{l_1}{l_2} \quad \text{(EQ 50)}$$

$$\tau_C = \frac{\Delta l}{c_S} \quad \text{(EQ 51)}$$

$$\tau_S = \tau_C f_S, \quad \text{(EQ 52)}$$

where $c_S$ is the speed of sound (m/s).

We then construct the spatial channel impulse response, $C^t$. $c_{LL}^t = c_{RR}^t$ is an n-tap identity FIR. $c_{LR}^t = c_{RL}^t$ is constructed by inserting g (EQ 50) into $\tau_S$-th (EQ 52) tap of an n-element zero vector. If $\tau_S$ is non-integer it may be rounded to a nearest integer. We next construct the spatial channel frequency response, C, represented by its component filters $c_{LL} = c_{RR}$ and $c_{LR} = c_{RL}$, by performing an n-point DFT on the $C^t$ component filters $c_{LL}^t = c_{RR}^t$ and $c_{LR}^t = c_{RL}^t$.

Next, construct crosstalk canceller frequency response, H, as follows. For a given spectral coloration level Γ dB calculate the aggregated frequency-dependent regularisation parameter as follows.

$$\rho(\omega) = \max\{\rho_I(\omega), \rho_{II}(\omega), 0\}. \quad \text{(EQ 53)}$$

For each frequency ω assemble a matrix $C^\omega$ such that $$C^\omega = \begin{bmatrix} c_{LL}(j\omega) & c_{LR}(j\omega) \\ c_{RL}(j\omega) & c_{RR}(j\omega) \end{bmatrix} \quad \text{(EQ 54)}$$

For each frequency ω estimate the crosstalk canceller frequency response, $H^\omega$ such that:

$$H^\omega = [C^{\omega(H)} C^\omega + \rho(\omega) I]^{-1} C^{\omega(H)} = \begin{bmatrix} h_{LL}^\omega(\omega) & h_{LR}^\omega(\omega) \\ h_{RL}^\omega(\omega) & h_{RR}^\omega(\omega) \end{bmatrix} \quad \text{(EQ 55)}$$

where superscript $^{(H)}$ represents Hermitian conjugation operator.

It is to be noted that regularisation occurs naturally at the frequencies where ρ(ω)>0 which is where the magnitude frequency response of the unregularised XTC exceeds Γ dB. Otherwise, ordinary least-squares inversion is performed as there is no need for the regularisation. We construct the XTC impulse response, $H^t$, represented by its component filters $h_{LL}^t = h_{RR}^t$ and $h_{LR}^t = h_{RL}^t$, by performing an n-point inverse DFT (IDFT) on the $H^\omega$ component filters $h_{LL}^\omega = h_{RR}^\omega$ and $h_{LR}^\omega = h_{RL}^\omega$, followed by a cyclic shift of n 2. This completes construction of this embodiment of the crosstalk canceller frequency response, H. The calculated component filters coefficients $h_{LL}^t = h_{RR}^t$ and $h_{LR}^t = h_{RL}^t$ of the XTC are thus loaded into the two-input two-output filter structure H. Once again, this is a one-off design process and the component filters coefficients of H need no further change.

It is further to be noted that other special cases derived from the generalised playback system are possible, e.g. same plane loudspeaker placement of non-identical speakers; orthogonal plane loudspeaker placement of identical speakers, etc. Solutions for these special cases can be easily derived from the above described solution for the generalised playback geometry case and are thus to be considered within the scope of the present invention.

Figure 8:
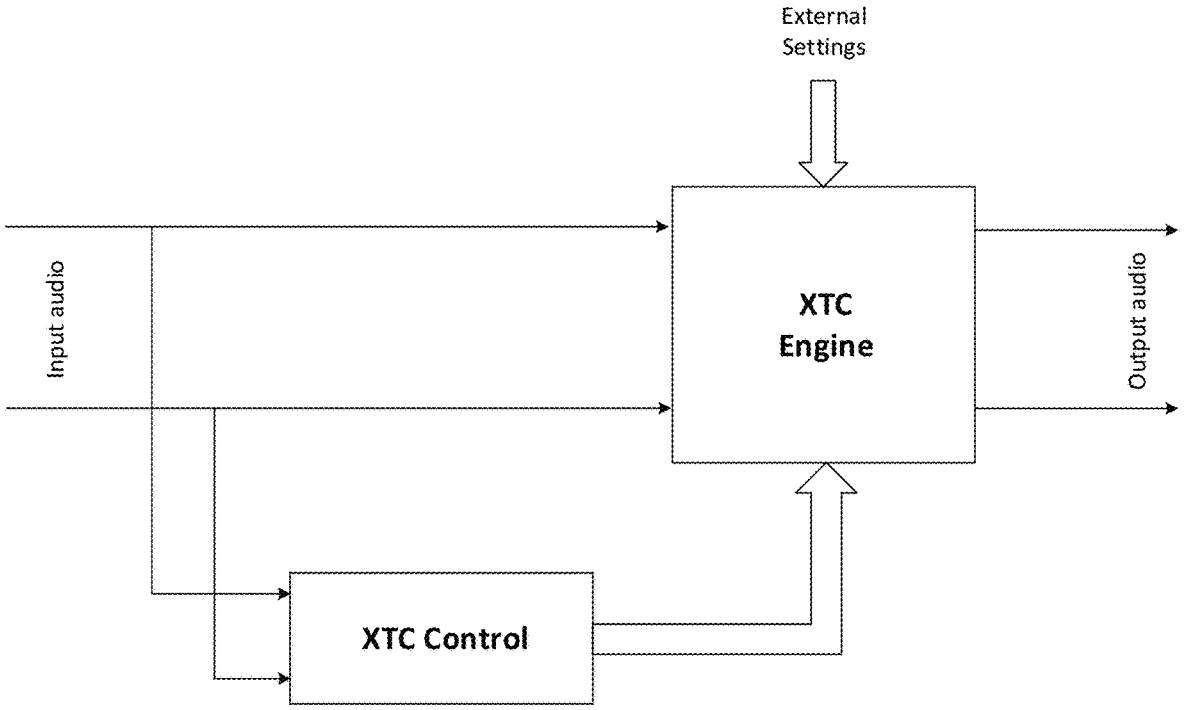
FIG. 8 is a block-diagram of an XTC module in accordance with an embodiment of the invention.

A block-diagram of a XTC module in accordance with one embodiment of the invention is shown in FIG. 8. A digital stereo signal comprising input audio represented by its left and right audio channels is input into the XTC Control module. The XTC Control module calculates specific metrics and produces enable/disable flags for the XTC Engine. These metrics may for example include left and right channel signal power calculated on a per frame basis or any other basis; combined left and right channel signal power; difference between left and right channel signal powers, left and right channel signal variation and others. The specific metrics are used to produce a "non-zero audio activity" flag, and/or to detect the presence of stereo audio in the input, for example. For example if no signal activities are detected on either of the left and right channels, or the input audio is mono, then the XTC Control module produces the "disable" flag and the XTC Engine module works in a "passthrough" mode where the XTC component filters are not applied. Otherwise, the XTC Control module produces the "enable" flag and the XTC Engine starts applying its component filters loaded through the External Settings interface.

Figure 9:
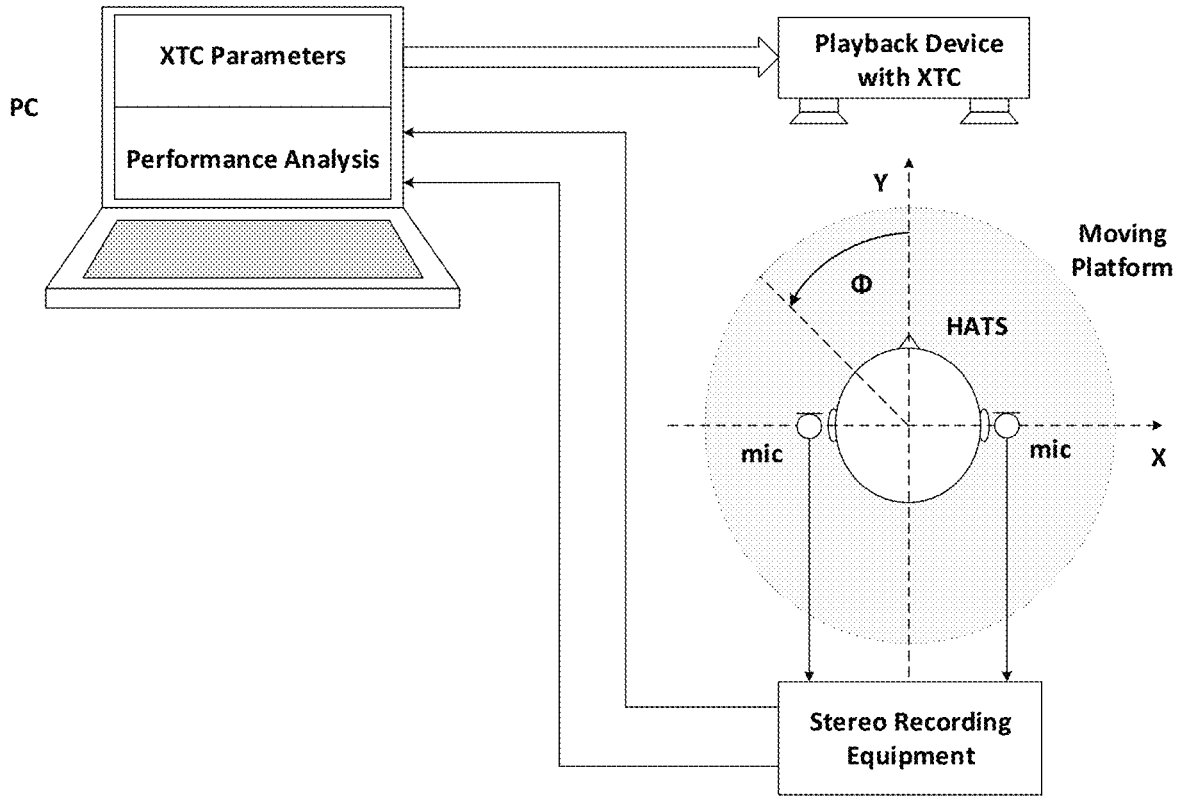
FIG. 9 illustrates the software and apparatus for designing a crosstalk canceller for a particular use mode, in accordance with the present invention.

In the above described embodiments it is further necessary to provide software and apparatus for the one-off XTC development. FIG. 9 shows a setup for such XTC development. It consists of a Head And Torso Simulator (HATS) mannequin, a PC, and a playback device (or prototype) for which the XTC is being developed. The HATS is placed on a moving platform. The platform can be moved by a predefined and measurable distance along the (X,Y) plane from its nominal position, and rotate by an angle Φ, in order to investigate the impact of the (X,Y) displacement on the XTC performance. A high-end microphone is fixed at each (left and right) ear canal entrance. Outputs of each microphone are connected to a stereo recording equipment which is used to perform recording of the crosstalk-cancelled audio. All audio recordings can be made at an arbitrary sampling frequency and high bit sample resolution.

The audio recording device is connected to a PC via an audio interface; an audio playback/analysis software is used to evaluate performance of the XTC being developed. Also the PC is running an XTC generator tool which generates the XTC component filters $h_{LL}^t$, $h_{RR}^t$, $h_{LR}^t$, and $h_{RL}^t$ given an input parameter vector u as described in the previous sections. The calculated component filters $h_{LL}^t$, $h_{RR}^t$, $h_{LR}^t$, and $h_{RL}^t$ can be loaded into the playback device where they are used to preprocess the original stereo audio signal in order to cancel acoustic interference. The playback device may be implemented as a prototype board/device with a digital signal processor (DSP) used to implement the XTC. It has analog front-end which includes DAC, power amplifier, and two loudspeakers (FIGS. 2*a* and 5*a*).

Accordingly, the process of the XTC development is as follows. For a given playback device, and for a given playback scenario (e.g. watching a music video on a smartphone), define an input parameter vector G. For the chosen music video playback scenario the input parameter vector may take the following values: $\vec{u}$=[0.13 (m), 0.5 (m), 0.175 (m), 7 (dB), 512 (taps), 48 (kHz)] (this being a special case of the same plane identical loudspeakers placement). Given the parameterised vector $\vec{u}$ the XTC generator tool running on the PC generates the XTC component filters $h_{LL}^t$, $h_{RR}^t$, $h_{LR}^t$, and $h_{RL}^t$ given an input parameter vector $\vec{u}$=[$r_S$, $r_h$, Δr, Γ, n, $f_S$,] as described in the previous section. The four 512-tap component filters are loaded into the playback device and applied on to the input audio. The processed audio is played through the loudspeakers, and after propagation through the spatial channel is registered on the left and right microphones. Then the analog audio signal (both channels) is passed to the stereo recording equipment where it is amplified, sampled and quantised and recorded into an audio file. It should be noted that the HATS is used only to imitate the impact of human head on the acoustic channel and thus on the crosstalk cancelling characteristics. The audio file is copied to the PC and loaded into the audio playback/analysis software where its quality is analysed both subjectively and objectively.

Sensitivity of the developed XTC performance to a listener's head position can be assessed by applying some (X,Y, Φ) displacement on to the HATS using the moving platform. The process of playback, recording, and performance evaluation is performed as specified above. In order to develop an XTC with different properties, for example for a different use mode, the vector $\vec{u}$ is adjusted and the process of XTC development and performance assessment is repeated. Thus more than one XTC may be developed and stored in the playback device in respect of more than one use mode, with the appropriate XTC to use at any given time being defined simply by the use mode of the device.

It is to be appreciated that the method and device described herein may embody the present invention in software or firmware held by any suitable computer-readable storage medium including non-transitory media, and may be executed by a general purpose processor or an application specific processor such as a digital signal processor.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not limiting or restrictive.

The invention claimed is:

1. A device for reducing acoustic crosstalk at a time of audio playback, the device comprising:

a processor configured to pass a stereo audio signal through a crosstalk canceller, wherein the crosstalk canceller comprises a regularised inverse transfer function of an acoustic stereo playback path having asymmetries defined by stereo playback speakers having unequal directivity with respect to the device, wherein the crosstalk canceller is configured to provide acoustic crosstalk cancellation in relation to the speakers having unequal directivity, and wherein the crosstalk canceller has been regularised by aggregated frequency dependent regularisation parameters; and further configured to pass an output of the crosstalk canceller to the stereo playback speakers for acoustic playback.

2. The device of claim 1, wherein the aggregated frequency dependent regularisation parameters are selected so that the crosstalk canceller is configured to provide for an amount of crosstalk cancellation and spectral coloration in one part of the audio spectrum which is different from an amount of crosstalk cancellation and spectral coloration in another part of the audio spectrum.

3. The device of claim 2, wherein the aggregated frequency dependent regularisation parameters are selected to be generally larger at high frequencies, so that the crosstalk canceller is configured to provide less crosstalk cancellation and less spectral coloration at high frequencies.

4. The device of claim 2, wherein the crosstalk canceller is configured to provide less crosstalk cancellation and less spectral coloration above 8 kHz.

5. The device of claim 1, wherein the acoustic crosstalk canceller is configured to provide for matching of loudspeaker frequency response so that a difference between loudspeakers' respective frequency responses is reduced.

6. The device of claim 1, comprising a respective acoustic crosstalk canceller in relation to each of a plurality of expected use modes of the device.

7. The device of claim 6, comprising a first crosstalk canceller configured for landscape playback, and comprising a second crosstalk canceller configured for portrait playback, and wherein the processor is configured to detect whether the device is being held in a landscape or portrait position and to use the respective first or second crosstalk canceller at a time of audio or video playback.

8. The device of claim 1, wherein the crosstalk canceller has been regularised by aggregated frequency dependent regularisation parameters without band branching.

9. A method of determining an acoustic crosstalk canceller for an asymmetric; audio playback device, the method comprising:

determining a transfer function of an acoustic stereo playback path having asymmetries defined by speakers of the playback device having unequal directivity with respect to the device; inverting the transfer function to determine an inverse transfer function;

regularising the inverse transfer function by applying aggregated frequency dependent regularisation parameters to obtain an acoustic crosstalk canceller.

10. The method of claim 9, wherein the aggregated frequency dependent regularisation parameters are selected so that the crosstalk canceller is configured to provide for a different amount of crosstalk cancellation and spectral coloration in one part of the audio spectrum as compared to another part of the audio spectrum.

11. The method of claim 10, wherein the aggregated frequency dependent regularisation parameters are selected to be generally larger at high frequencies, so that the crosstalk canceller is configured to provide less crosstalk cancellation and less spectral coloration at high frequencies.

12. The method of claim 10, wherein the crosstalk canceller is configured to provide less crosstalk cancellation and less spectral coloration above 8 kHz.

13. The method of claim 9, wherein the acoustic crosstalk canceller is configured to provide for matching of loudspeaker frequency response so that a difference between loudspeakers' respective frequency responses is reduced.

14. The method of claim 9, when performed more than once in respect of the audio playback device so as to determine a respective acoustic crosstalk canceller in relation to each of a plurality of expected use modes of the device.

15. The method of claim 14, wherein a first crosstalk canceller is designed and stored in the device in respect of landscape video playback, and a second crosstalk canceller is designed and stored in the device in respect of portrait video playback, so that selection of the appropriate crosstalk canceller may be made at a time of video playback based on whether the device is being held in a portrait or landscape position.

16. The method of claim 9, wherein regularising the inverse transfer function by applying aggregated frequency dependent regularisation parameters comprises regularising the inverse transfer function by applying aggregated frequency dependent regularisation parameters without band branching.

17. The method of claim 9, comprising deriving a directionality matrix representing directivity gains from each speaker to each ear.

18. A device for determining an acoustic crosstalk canceller for an asymmetric audio playback device, the device comprising:

a processor configured to determine a transfer function of an acoustic stereo playback path having asymmetries defined by speakers of the playback device having unequal directivity with respect to the device; invert the transfer function to determine an inverse transfer function; and regularise the inverse transfer function by applying aggregated frequency dependent regularisation parameters to obtain an acoustic crosstalk canceller.

19. A method of reducing acoustic crosstalk at a time of audio playback, the method comprising:

passing a stereo audio signal rough a crosstalk canceller, wherein the crosstalk canceller comprises a regularised inverse transfer function of an acoustic stereo playback path having asymmetries defined by stereo playback speakers having unequal directivity with respect to the device, wherein the crosstalk canceller has been regularised by aggregated frequency dependent regularisation parameters; and passing an output of the crosstalk canceller to the stereo playback loudspeakers for acoustic playback.

20. A device for reducing acoustic crosstalk at a time of audio playback, the device comprising:

a processor configured to pass a stereo audio signal through a crosstalk canceller, wherein the crosstalk canceller comprises a regularised inverse transfer function of an acoustic stereo playback path having asymmetries defined by stereo playback speakers having unequal directivity with respect to the device, wherein the crosstalk canceller has been regularised by aggregated frequency dependent regularisation parameters; and further configured to pass an output of the crosstalk canceller to stereo loudspeakers for acoustic playback.

21. A method of determining an acoustic crosstalk canceller for an asymmetric audio playback device, the method comprising:

determining a transfer function of an acoustic stereo playback path having asymmetries defined by stereo playback speakers having unequal directivity with respect to the device;

inverting the transfer function to determine an inverse transfer function;

regularising the inverse transfer function by applying aggregated frequency dependent regularisation parameters, to obtain an acoustic crosstalk canceller.

22. A non-transitory computer readable medium for determining an acoustic crosstalk canceller for an audio playback device, comprising instructions which, when executed by one or more processors, causes performance of the method of claim 9.

23. A non-transitory computer readable medium for determining an acoustic crosstalk canceller for an audio playback device, comprising instructions which, when executed by one or more processors, causes performance of the method of claim 21.

24. A device for determining an acoustic crosstalk canceller for an asymmetric audio playback device, the device comprising;

a processor configured to determine a transfer function of an acoustic stereo playback path having asymmetries defined by stereo playback speakers having unequal directivity with respect to the device; invert the transfer function to determine an inverse transfer function; and regularise the inverse transfer function by applying aggregated frequency dependent regularisation parameters, to obtain an acoustic crosstalk canceller.

25. A method of reducing acoustic crosstalk at a time of audio playback, the method comprising:

passing a stereo audio signal through a crosstalk canceller, wherein the crosstalk canceller comprises a regularised inverse transfer function of an acoustic stereo playback path having asymmetries defined by stereo playback speakers having unequal directivity with respect to the device, wherein the crosstalk canceller has been regularised by aggregated frequency dependent regularisation parameters; and passing an output of the crosstalk canceller to stereo loudspeakers for acoustic playback.

26. A non-transitory computer readable medium for reducing acoustic crosstalk at a time of audio playback, comprising instructions which, when executed by one or more processors, causes performance of the method of claim 19.

27. A non-transitory computer readable medium for reducing acoustic crosstalk at a time of audio playback, comprising instructions which, when executed by one or more processors, causes performance of the method of claim 25.

* * * * *